US009586661B1

(12) United States Patent
Braun et al.

(10) Patent No.: US 9,586,661 B1
(45) Date of Patent: Mar. 7, 2017

(54) UNMANNED UNDERWATER VEHICLE SEA FLOOR SEPARATION DEVICE

(71) Applicant: The United States of America as represented by the Secretary of the Navy, Washington, DC (US)

(72) Inventors: Daniel Joseph Braun, San Diego, CA (US); Wayne Po-wen Liu, San Diego, CA (US); Peter Thomas Sullivan, San Diego, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 0 days.

(21) Appl. No.: 14/987,502

(22) Filed: Jan. 4, 2016

(51) Int. Cl.

| | |
|---|---|
| ***B63G 8/14*** | (2006.01) |
| ***B63G 8/00*** | (2006.01) |
| ***F04B 43/12*** | (2006.01) |
| ***F04B 43/00*** | (2006.01) |

(52) U.S. Cl.
CPC ..... *B63G 8/00* (2013.01); *B63G 8/001* (2013.01); *F04B 43/0009* (2013.01); *F04B 43/12* (2013.01); *B63G 2008/002* (2013.01)

(58) Field of Classification Search
CPC .. B63B 1/38; B63G 8/00; B63G 8/001; B63G 8/002; F04B 43/0009; F04B 43/12
USPC ..... 114/67 A, 331
See application file for complete search history.

(56) References Cited

U.S. PATENT DOCUMENTS

| | | | | |
|---|---|---|---|---|
| 3,016,865 | A * | 1/1962 | Eichenberger | B63B 1/38 114/20.1 |
| 3,593,685 | A * | 7/1971 | Cowles | B63B 1/38 114/67 A |
| 3,749,162 | A * | 7/1973 | Anders | E21B 7/008 114/264 |
| 3,983,833 | A * | 10/1976 | Eickmann | B63B 1/246 244/17.23 |
| 6,167,829 | B1 * | 1/2001 | Lang | B63B 1/107 114/272 |
| 2014/0290554 | A1 * | 10/2014 | Brizard | B63G 8/001 114/331 |
| 2016/0257386 | A1 * | 9/2016 | Bhattacharyya | B63G 8/08 |
| 2016/0274259 | A1 * | 9/2016 | Daniel | G01V 1/3808 |

* cited by examiner

*Primary Examiner* — Stephen Avila
(74) *Attorney, Agent, or Firm* — SPAWAR Systems Center Pacific; Kyle Eppele; Susanna J. Torke

(57) ABSTRACT

A device comprising a first plate disposed on top of a second plate where the first and second plates are parallel and separated by a fixed distance with a spacer, and wherein the spacer fits around the perimeter of the first and second plates creating a void space, and wherein the second plate has a plurality of pin-sized holes, and wherein a pump sits in the void space and is operably coupled to the plates, wherein the plates are operably coupled to the bottom, exterior hull of an Unmanned Underwater Vehicle (UUV), and wherein the pump is configured to pump liquid into the void space between the parallel plates.

15 Claims, 5 Drawing Sheets

UNMANNED UNDERWATER VEHICLE SEA FLOOR SEPARATION DEVICE

FEDERALLY-SPONSORED RESEARCH AND DEVELOPMENT

The Unmanned Underwater Vehicle (UUV) Sea Floor Separation Device is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-5118; email ssc_pac T2@navy.mil. Reference Navy Case Number 102371.

BACKGROUND

Unmanned underwater vehicles (UUVs) are very capable of mapping and inspecting sections of sea floors or harbors. They are currently incapable of repeatedly bottoming themselves into mud-like sea floors and separating due to being suctioned to the sea floor. Bottoming is a term that refers to the intentional contact with the bottom of a body of water and the arresting of motion in that location at the bottom of a body of water. The mud, at the bottom of the sea floor or harbor, places a suction force on any bottomed object, and actively resists separation. There is a need for an improved UUV design that provides the capability of countering these suction forces and allowing for separation from the sea floor.

Prior systems aimed at avoiding the sea floor altogether to prevent the vehicle from adhering to the mud or to prevent damage to a UUV. This device provides a UUV with a new capability of bottoming into mud and successfully separating.

DETAILED DESCRIPTION OF SOME EMBODIMENTS

Figure 1:
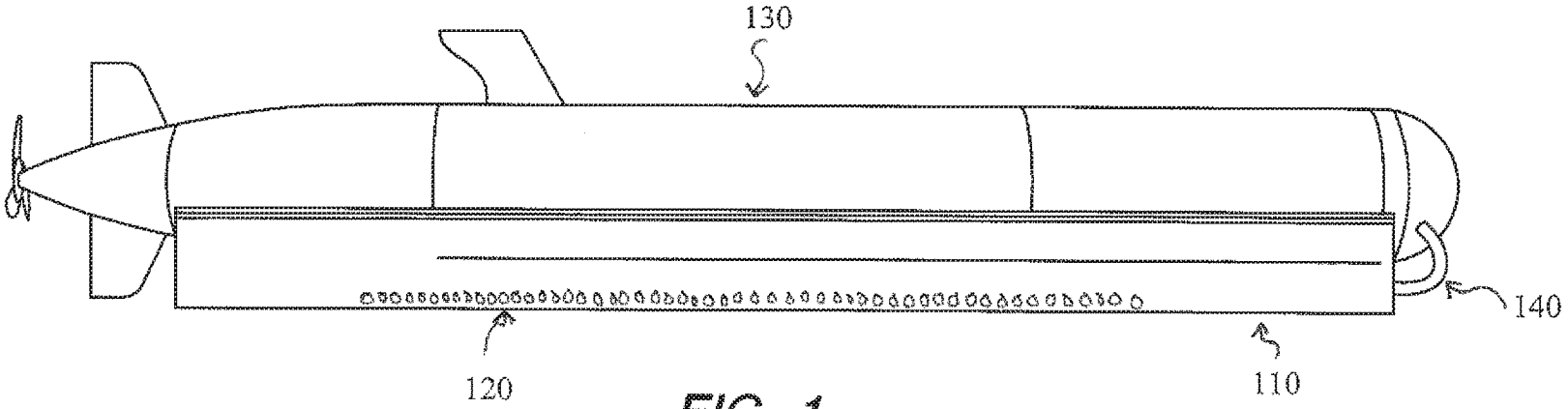
FIG. 1 shows a side view of a UUV having a curved bottom in accordance with a UUV Sea Floor Separation Device.

Reference in the specification to "one embodiment" or to "an embodiment" means that a particular element, feature, structure, or characteristic described in connection with the embodiments is included in at least one embodiment. The appearances of the phrases "in one embodiment," "in some embodiments," and "in other embodiments" in various places in the specification are not necessarily all referring to the same embodiment or the same set of embodiments.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

Additionally, use of the "a" or "an" are employed to describe elements and components of the embodiments herein. This is done merely for convenience and to give a general sense of the invention. This detailed description should be read to include one or at least one and the singular also includes the plural unless it is obviously meant otherwise.

This Unmanned Underwater Vehicle (UUV) Sea Floor Separation Device provides the capability for a UUV to repeatedly separate itself from the sea floor. In one embodiment, the device is comprised of a first plate positioned on top of and parallel to a second plate, where the first plate and second plate are separated by a spacer, and a pump. The pump draws water from an outside system, such as the surrounding sea, at ambient pressure, into the space created by the spacer situated between the two parallel plates. The top plate has no perforations, but the bottom plate is partially or fully perforated with a plurality of pin-sized holes or openings, which allow fluid to seep out or be forced out with the pump. There are several potential embodiments of the pattern of the pin-sized holes—they need not be spotted in a uniform or matrix-like pattern, but could be arranged in a spoke-hub type fashion so as to facilitate water intrusion towards the underbody, or any other design as would be recognized by one having ordinary skill in the art. For example, in one embodiment, the holes make up an X-like pattern on the bottoming plate, and in another embodiment the holes make up a starfish-like pattern on the bottoming plate. In both embodiments, the water can be concentrated in such a way as to invite water seepage into the mud (vs. uniformly spaced matrix of holes).

In one embodiment, the plates are coupled to the UUV, either via screws or nails or a similar mechanism for attachment. The UUV can either have a flat bottom or a curved bottom, and the plates would either be curved or straight depending on the corresponding UUV's structure. The holes can be arranged similarly for either shape, and arranging the holes in a line that follows the circumference of the plates naturally allows seawater to seek out and invade the vacuum pocket that is holding the vehicle in the mud. The starfish shape or X shape allows fluid to be forced out of the holes and can facilitate having one corner or edge separate first. If just one corner or edge could separate first, seawater would intrude and assist in separation.

The spacer plate separates the top and bottom plates by a fixed distance dictated by the thickness of the spacer plate. The spacer plate can be thought of as a gasket, and fits around the perimeter of the top and bottom plates creating a seal between the two parallel plates and creating a void for water to be pumped into. The flooded void is just slightly pressurized above ambient sea pressure when water is pumped into the vacant water space between the parallel plates.

The pump can be located within the UUV, outside the UUV, onboard the separation system, or any other location as would be recognized by one having ordinary skill in the art. The pump can be a peristaltic pump, diaphragm pump, rotary pump, or another similar pump.

The pressurized water, once pumped into the void space between the top and bottom plates, only has one option to exit and keep the system in hydrostatic balance. The pressurized water in the void space exits through the multitude of perforated pin-sized holes in the bottom plate. If the bottom plate is in contact with the mud on the bottom of the sea floor, the exiting water is capable of eroding the mud beneath the exit of the holes. Eventually, enough mud will be eroded beneath the bottom plate to reduce the suction force from the mud to a state that the system can fully separate. In this embodiment, the force to lift the system off the mud, once the suction force is reduced, comes from positive buoyancy of the system. This can be created with ballasting, a buoyancy engine, or a plurality of methods.

FIG. 1 shows a side view of a UUV Sea Floor Separation Device 100, having a curved-bottom UUV 130. UUV Sea Floor Separation Device 100 has a bottom plate 110, with a plurality of pin-sized holes 120. Although not quite visible in this figure, a spacer plate is right above bottom plate 110, and a top plate is on top of the spacer plate and is operably connected to UUV 130. These plates are fully visible in FIGS. 3A-3C and FIG. 7. Pump 140 is operably connected to UUV 130, and takes water in from an outside source and pumps it into the void space in between bottom plate 110 and the top plate, not visible in this figure but visible in FIG. 7.

Figure 2:
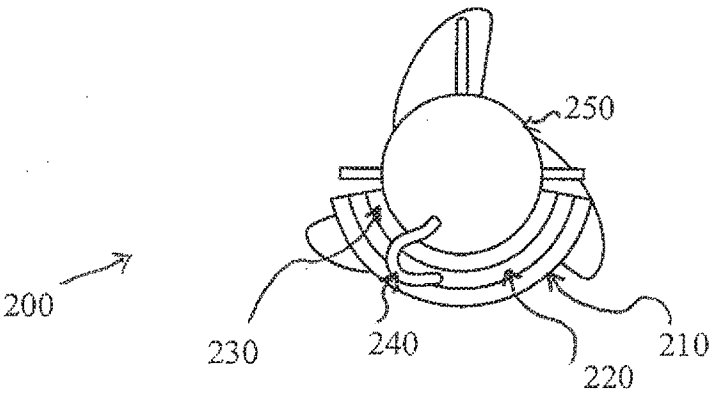
FIG. 2 shows a rear view of a UUV having a curved bottom in accordance with a UUV Sea Floor Separation Device.

FIG. 2 shows a rear view of a UUV Sea Floor Separation Device 200, having a curved UUV 250. UUV Sea Floor Separation Device 200 has a bottom plate 210, a spacer plate 220, and a top plate 230 that is operably connected to UUV 250. Although not visible in this view, spacer plate 220 leaves a void space between bottom plate 210 and top plate 230. Pump 240 is operably connected to UUV 250, and it forces water into the void space between bottom plate 210 and top plate 230.

Figures 3A, 3B, 3C:
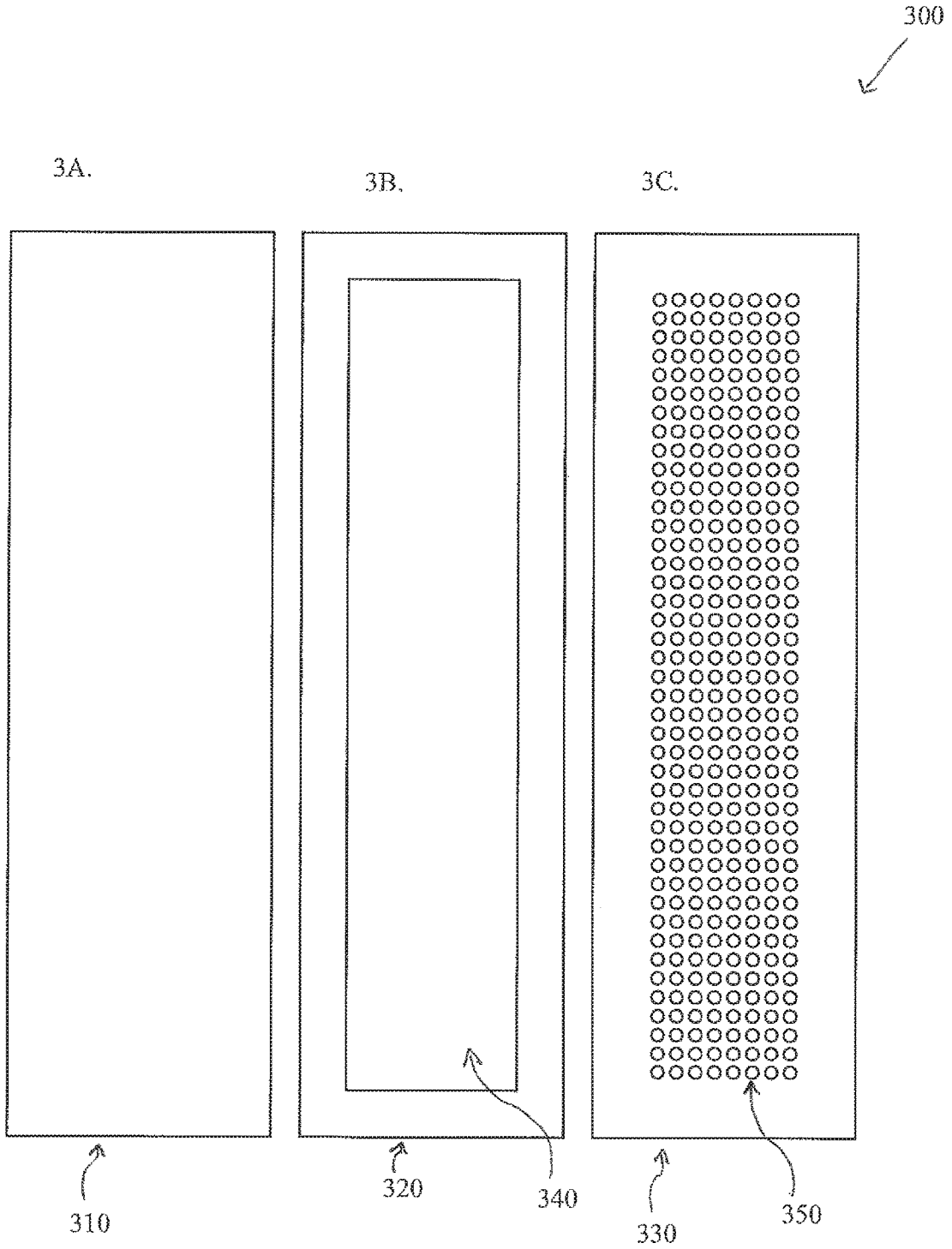
FIGS. 3A-3C show a top view of the top plate, spacer plate, and bottom plate, respectively, in accordance with a UUV Sea Floor Separation Device.

FIGS. 3A-3C show an extended, separated view of the plates in FIGS. 1 and 2. UUV Sea Floor Separation Device 100 and 200 have a top and bottom plate and a spacer plate that are depicted here in FIGS. 3A-3C. Top plate 310 is a solid plate and is the plate coupled to UUV 130 or 250. Bottom plate 330 has a plurality of pin-sized holes. Spacer plate 320 fits only around the perimeter and in between top plate 310 and bottom plate 330, as is also visible from spacer 720 in FIG. 7. A void space 340 is created with spacer plate 320 into which pump 240 can pump water. The water is essentially forced out of the pin-sized holes 350 in bottom plate 330.

Figure 4:
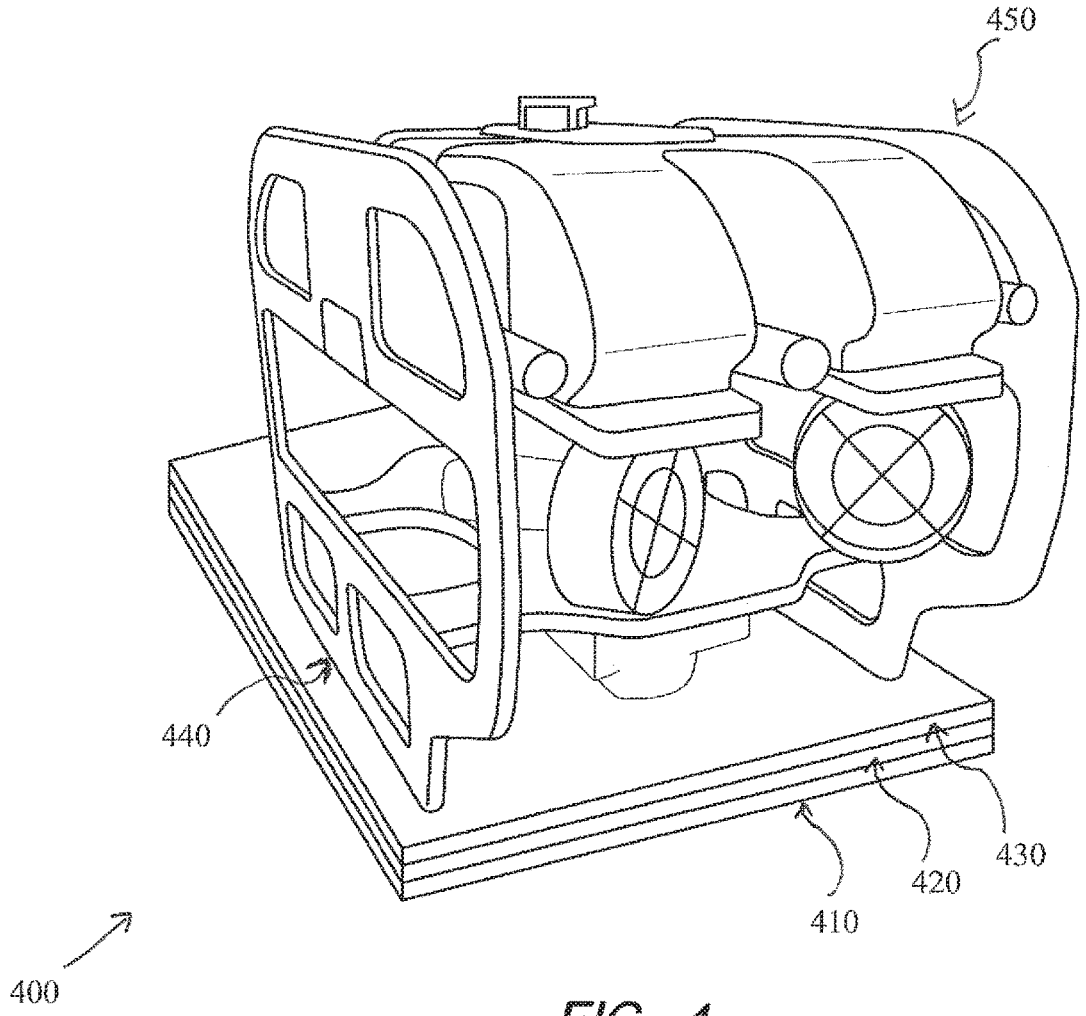
FIG. 4 shows a rear view of a UUV having a flat bottom in accordance with a UUV Sea Floor Separation device.

FIG. 4 shows a Sea Floor Separation Device 400 having a flat-bottomed UUV 450. UUV 450 is operably coupled to the top surface 440 of top plate 430. Underneath top plate 430 is spacer plate 420. Beneath spacer plate 420 is bottom plate 410. Spacer plate 420 fits around only the perimeter of top plate 430 and bottom plate 410. Although not visible here, bottom plate 410 has a plurality of holes similar to bottom plate 330.

Figure 5:
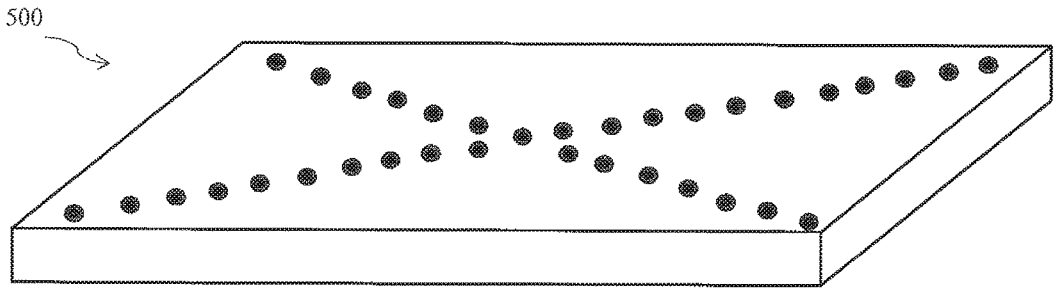
FIG. 5 shows a top view of a bottom plate having pin-sized holes in an X formation in accordance with a UUV Sea Floor Separation Device.

FIG. 5 is an embodiment of bottom plate 500 wherein the pin-sized holes are in an X-shape.

Figure 6:
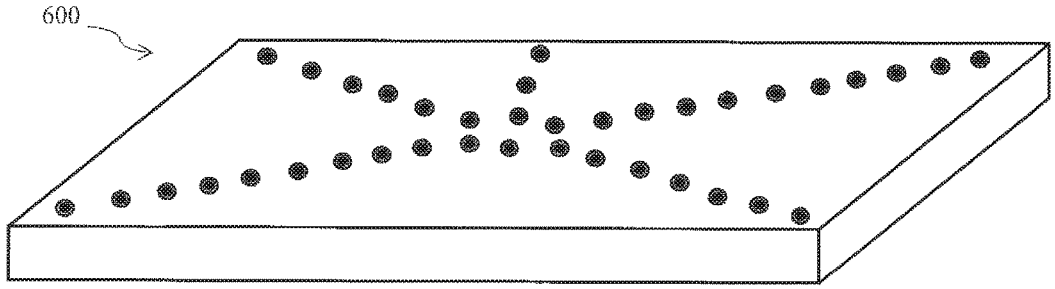
FIG. 6 shows a top view of a bottom plate having pin-sized holes in a starfish-like formation in accordance with a UUV Sea Floor Separation Device.

FIG. 6 is an embodiment of bottom plate 600 wherein the pin-sized holes are in a starfish-like formation.

Figure 7:
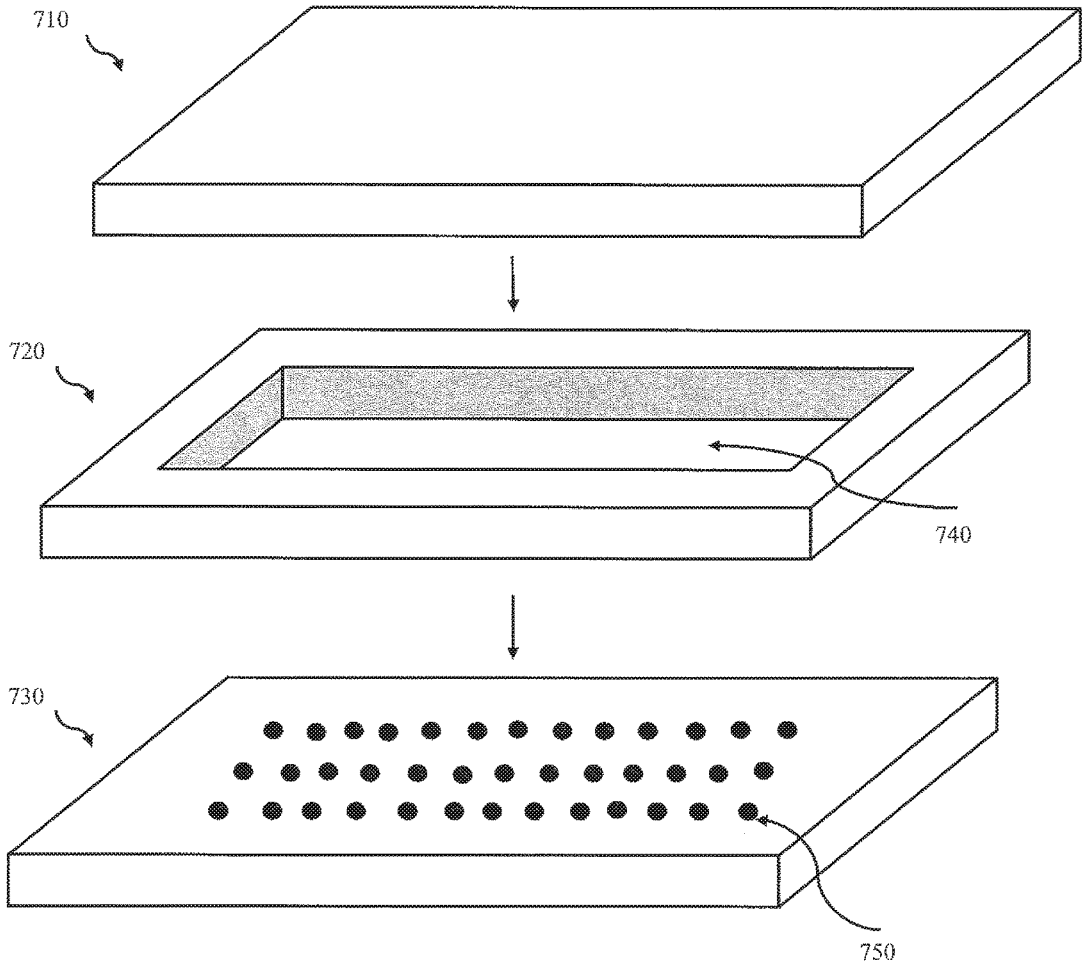
FIG. 7 shows an extended three-dimensional view of the top plate, spacer plate, and bottom plate.

FIG. 7 shows an extended three-dimensional view of top plate 710, spacer plate 720, and bottom plate 730. Spacer plate 720 is hollow, and thus when top plate 710, spacer plate 720, and bottom plate 730 are stacked, void space 740 exists into which water can be pumped. The water would then be forced out of the plurality of pin-sized holes 750 in the bottom plate, thus forcing the UUV to separate from the sea floor. Top plate 710 would be operably coupled to the bottom of a UUV, such as at the bottom of UUV 130.

We claim:

1. A device comprising a first plate disposed on top of a second plate wherein the first and second plates are parallel and separated by a fixed distance with a spacer, wherein the spacer fits around the perimeter of the first and second plates creating a void space, and wherein the second plate has a plurality of pin-sized holes, wherein a pump is disposed within the void space and is operably coupled to the plates, and wherein the plates are operably coupled to a bottom, exterior hull of an Unmanned Underwater Vehicle (UUV).

2. The device of claim 1 wherein the pin-sized holes in the second plate are arranged in an X-shape.

3. The device of claim 1 wherein the small pin-sized holes in the second plate are arranged in a starfish-like pattern.

4. The device of claim 1 wherein the plates are fully integrated into the body of a UUV, wherein the first plate comprises the bottom surface of the UUV.

5. The device of claim 1 wherein the pump is configured to pump liquid into the void space between the parallel plates.

6. The device of claim 5 wherein the pump is a peristaltic pump.

7. The device of claim 6 wherein the liquid is sea water.

8. The device of claim 7 wherein the sea water is forced out of the pin-sized holes.

9. A system for separating a UUV from the sea floor comprising:

a UUV;

two parallel plates, one on the top and one on the bottom, wherein the bottom plate has a plurality of pin-sized holes and the plates are operably coupled to a UUV;

a spacer plate in between the top and bottom plates fitting around the perimeter of the top and bottom plate, creating a seal and a void space between the top and bottom plates; and a pump operably coupled to the UUV, wherein the pump is disposed within the void space.

10. The system of claim 9 wherein the UUV is immersed in a body of sea water and is bottomed out on a sea floor.

11. The system of claim 10 wherein the pump is a peristaltic pump.

12. The system of claim 11 wherein the pump is configured to pump the sea water into the void space between the parallel plates.

13. The system of claim 12 wherein the void space, once the sea water is pumped in, is pressurized above ambient sea pressure.

14. The system of claim 13 wherein the pressurized water in the void space is forced through the multitude of pin-sized holes in the bottom of the plate.

15. A method for separating a UUV from a sea floor comprising the steps of:

bottoming a UUV on the sea floor, wherein the bottom of the UUV comprises two parallel plates, a spacer plate, and a pump, wherein the two parallel plates comprise a top plate and a bottom plate, the bottom plate having a plurality of pin-sized holes, and the spacer plate fitting in between the top and bottom plates creating a void space, and wherein the pump is disposed within the void space; and using the pump to pump sea water into the void space, forcing the water out of the pin sized holes.

* * * * *